US007139710B1

(12) United States Patent
Bontrager

(10) Patent No.: US 7,139,710 B1
(45) Date of Patent: Nov. 21, 2006

(54) AUDIO SYNTHESIS OF A CURRENTLY TUNED FREQUENCY

(75) Inventor: Rich Bontrager, Shawnee Mission, KS (US)

(73) Assignee: Honeywell International, Inc., Morristown, NJ (US)

( * ) Notice: Subject to any disclaimer, the term of this patent is extended or adjusted under 35 U.S.C. 154(b) by 1080 days.

(21) Appl. No.: 09/709,809

(22) Filed: Nov. 9, 2000

Related U.S. Application Data

(60) Provisional application No. 60/164,598, filed on Nov. 10, 1999.

(51) Int. Cl.
*G10L 13/00* (2006.01)

(52) U.S. Cl. ..... 704/260; 704/274

(58) Field of Classification Search ..... 704/258, 704/260, 270, 274, 276–278
See application file for complete search history.

(56) References Cited

U.S. PATENT DOCUMENTS 4,359,713 A * 11/1982 Tsunoda ..... 704/274
4,438,422 A * 3/1984 Nojiri et al. ..... 340/460
4,825,385 A * 4/1989 Dolph et al. ..... 704/274
5,220,681 A * 6/1993 Belgin ..... 455/156.1

FOREIGN PATENT DOCUMENTS

JP 01 313890 A * 12/1989

OTHER PUBLICATIONS

Jonathan Sinay, Integrated Communication, Radio Navigation and Identification System (ICRNI), IEEE 1990, pp. 424-429.*

* cited by examiner

*Primary Examiner*—David D. Knepper
(74) *Attorney, Agent, or Firm*—Ingrassia Fisher & Lorenz

(57) ABSTRACT

A system 10 is provided which is receptive to selective tuning at particular frequencies. The system 10 includes a display device 15, an audio synthesizer 14, and a controller 20. The controller 20 is in communication with the display device 15 and the audio synthesizer 14. The controller 20 communicates with the audio synthesizer 14 when a malfunction is detected with respect to the display device 15. In one embodiment, the audio synthesizer 14 produces an audible announcement of a frequency at which the system 10 is currently tuned.

22 Claims, 3 Drawing Sheets

AUDIO SYNTHESIS OF A CURRENTLY TUNED FREQUENCY

This application claims the benefit of U.S. Provisional Application No. 60/164,598, filed Nov. 10, 1999.

BACKGROUND OF THE INVENTION

1. Field of the Invention

The present invention relates generally to the audio synthesis of signals. More particularly, the present invention relates to the audio synthesis of signals, which correspond to navigation and/or communication frequencies.

2. Background of the Invention

Transportation vehicles, such as airplanes, water crafts, and ground vehicles, often depend upon signals (or beacons) to facilitate accurate navigation. For example, an airplane may receive satellite, ground, or airborne navigation signals from various navigational aids, which enables the airplane to determine bearing, heading, distance vectors, location, and so forth. Similarly, these vehicles may also employ a communications system, which facilitates communication to and from the vehicles.

Navigation and communication systems typically operate at set frequencies or over a range of frequencies. These systems can be manually or automatically tuned to a particular frequency. For example, as shown in FIG. 1, system 1 (e.g., a navigational system, a communications system or a navigation/communications system) includes a receiver (and/or a transceiver) 2, a display device 3, and a frequency selector 4 (e.g., a knob, dial, key pad, digital selector, analog selector, and so forth). A frequency selector 4 in the form of a dial may include a plurality of detent clicks 4*a*, each of which corresponds to a frequency step. The display device 3 is of a known variety, such as a LED, liquid crystal, active matrix, thin film, and so forth. Such a display device 3 may be integral to system 1, as shown in FIG. 1, or may be an external device, which is not part of system 1. Of course, system 1 may include multiple display devices and corresponding multiple frequency selectors. System 1 may also include other components, such as a microprocessor, frequency tunning circuitry, and so forth.

An operator (e.g., a pilot) manipulates or turns the selector 4 to tune the system 1 to a particular frequency. Typically, the currently tuned or selected frequency is displayed via the display device 3. For purposes of this discussion, a "currently tuned frequency" includes a frequency at which the radio is presently tuned to, and/or a frequency which is selected by an operator. If the system 1 is tuned to 900 MHz, "900 MHz," "900," "9," or some other "indicator" will be displayed via the display device 3. In this manner, an operator obtains visual feedback of a selected frequency.

A display device 3 failure may occur during the operation of system 1. Such a failure hampers the selection of a navigation/communication frequency, since an operator is unable to visually determine (or confirm) the currently tuned frequency. A conventional mechanism for handling such a display device 3 failure requires the operator to initiate an "emergency mode." In the emergency mode, the system 1 is reset to a predetermined frequency. The operator then manually counts up or down from the predetermined frequency to tune the radio. For example, the operator turns the frequency selector 4, and counts the number of detent clicks 4*a* to determine the currently tuned frequency. This conventional process fails to provide the operator with an adequate feedback mechanism for determining the currently tuned frequency. As a result, frequency selection is hampered.

Moreover, without a feedback mechanism to alert the operator of the currently tuned frequency, the safety of the operator and passengers may be jeopardized.

Accordingly, there is a need for a feedback mechanism for a currently tuned frequency when a display device fails. There is also a need for an audio indication of the currently tuned frequency. There is a further need for a procedure for controlling feedback in a navigation and/or communication system during a display device failure.

SUMMARY OF THE INVENTION

The present invention addresses the problems associated with a display device failure by integrating a voice/audio synthesizer as a feedback mechanism with a navigation and/or communications system. In this manner, an operator may ascertain a frequency from an audible announcement (e.g., synthesized speech), despite a visual display failure.

According to a first aspect of the present invention, a method of providing information regarding a system is provided. The system is adapted to receive signals over a range of frequencies. The system is also adapted to tune to individual frequencies. The method includes the steps of: i) tuning the system to a first frequency; ii) visually displaying the first frequency during a first mode of operation; and iii) audibly announcing the first frequency during a second mode of operation.

According to another aspect of the present invention, a system which is receptive to selective tunning at particular frequencies is provided. The system includes a display device, an audio synthesizer, and a controller. The controller is in communication with the display device and the audio synthesizer. The controller communicates with the audio synthesizer when a malfunction is detected with respect to the display device.

According to still another aspect of the present invention, an apparatus which is tunable to a plurality of frequencies is provided. The apparatus includes a first feedback device, a second feedback device, and an electronic processor circuit. The electronic processor circuit communicates with the first feedback device and with the second feedback device, and selectively provides a first signal to the first feedback device and to the second feedback device.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

The preferred embodiments will be described with respect to a feedback mechanism for a navigation and/or communications system, hereinafter generally referred to as radio 10, with a particular application for an aircraft. Of course, the present invention is not limited to an application involving an aircraft. As will be appreciated by those skilled in the art, the inventive apparatus and methods are also applicable to other vehicles and devices, such as water craft, ground vehicles, positioning systems (e.g., Global Positioning Systems), and so forth.

Figure 1:
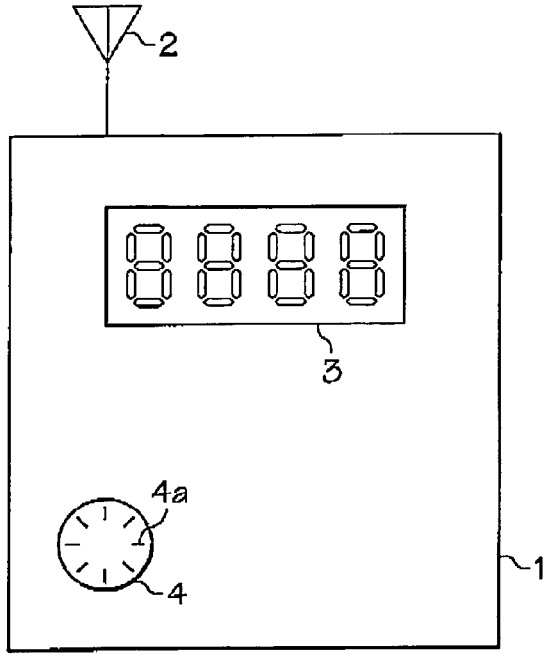
FIG. 1 is a block diagram of a conventional navigation and/or communications system.
Figure 2:
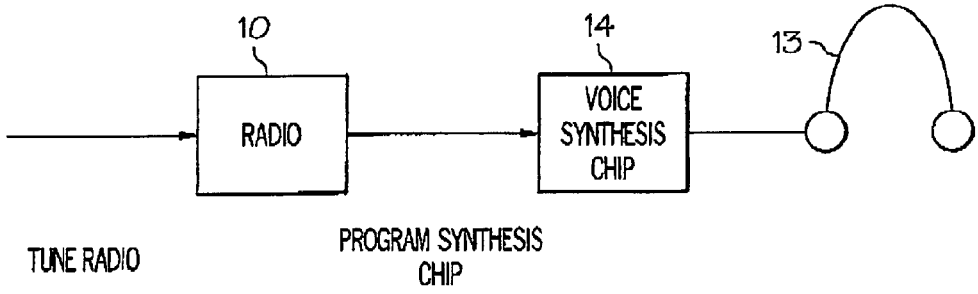
FIG. 2 is a functional block diagram of a navigation and/or communications system, which communicates with a voice synthesis chip.

With reference to FIG. 2, radio 10 outputs a signal to an audio synthesizer 14 (e.g., a voice and/or speech synthesis chip). Preferably, the signal corresponds to a frequency at which the radio 10 is currently tuned. The audio synthesizer 14 receives the signal and generates a signal corresponding to an audible pattern. The audio synthesizer 14 drives (e.g., outputs the corresponding signal to) a speaker 13, such as a headset shown in FIG. 2. Alternatively, the audio synthesizer 14 includes an internal speaker, and the corresponding signal communicates with the internal speaker to produce an audible announcement. Accordingly, a pilot audibly ascertains the frequency at which the radio 10 is currently tuned. This procedure is even further described below.

Figure 3A:
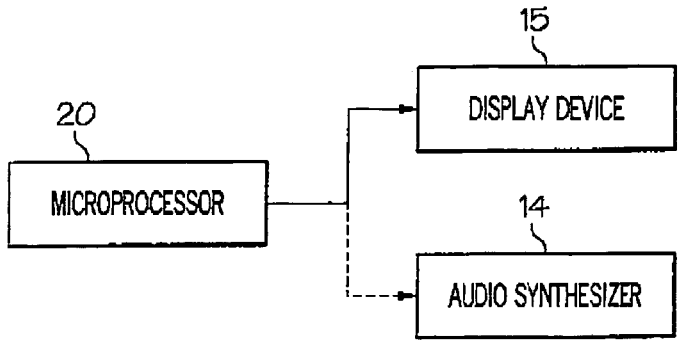
FIG. 3*a* is a functional block diagram of a system microprocessor communicating with feedback mechanisms.
Figure 4:
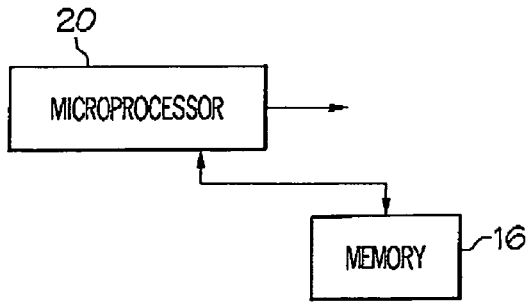
FIG. 4 is a functional block diagram of a system microprocessor communicating with an external memory device.

With reference to FIG. 3*a*, radio 10 preferably includes a microprocessor 20. Microprocessor 20 selectively communicates with display device 15, and with audio synthesizer 14. Display device 15 can be of a known variety, such as a LED, liquid crystal, active matrix, thin film, and so forth. Microprocessor 20 may include memory (e.g., Random Access Memory, or Read-Only Memory). Alternatively, microprocessor 20 may communicate with an external memory 16 (e.g., RAM, ROM, CD-ROM, magnetic memory, and so forth) as shown in FIG. 4.

Audio synthesizer chips are well known in the art. Such chips receive a signal and convert the signal into an audible pattern. For example, the signal may be in the form of a code or codeword, or may represent a voltage (or current) waveshape. The audio synthesizer 14 converts the codeword (or waveshape) into an audible pattern. For example, audio synthesizer 14 accesses a waveshape stored in non-volatile memory which corresponds to the codeword. Of course, other known audio signal processing techniques may be employed with the present invention. One example of an acceptable audio synthesizer chip is the MSM6585 ADPCM Voice Synthesis chip, manufactured by OKI Semiconductor, headquartered in Sunnyvale, Calif. Of course, other types and/or models of audio/voice synthesis chips may also be used with the present invention.

In a normal operating mode, such as when the display device 15 is functioning properly, a signal is output to display device 15. The signal may be output from microprocessor 20, or may be output from another radio 10 component (e.g., a tuner module, filter, register, data bus, digital circuit, and the like), under the direction of the microprocessor 20. The signal corresponds to a currently tuned frequency of radio 10 (e.g., 800 MHz). The display device 15 displays the currently tuned frequency, which can be visually inspected by a pilot. In this manner, the pilot benefits from a feedback mechanism (e.g., the visual display) to determine (or confirm) the frequency at which the radio 10 is currently tuned.

The pilot loses this feedback mechanism when the display device 15 fails or otherwise malfunctions. In such an event, an emergency mode is preferably entered. The emergency mode may be entered manually or automatically. To manually enter the emergency mode, the pilot restarts the radio 10, which triggers the emergency mode. Alternatively, the pilot selects an emergency switch, or otherwise enables the emergency mode. As a further alternative, the emergency mode is entered automatically upon the detection of a display device 15 failure. Such a failure is automatically detected by the presence (or absence) of status signals or flags, a diagnostic inquiry prompted by microprocessor 20, or a self-diagnostic performed by the display device 15.

Figure 3B:
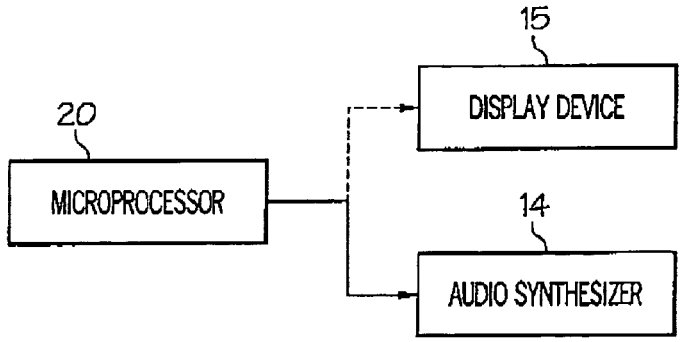
FIG. 3*b* is a functional block diagram of a system microprocessor communicating with feedback mechanisms.

With reference to FIG. 3*b*, in the emergency mode, a signal is output to audio synthesizer 14. The signal may be output from microprocessor 20, or may be output from another radio 10 component (e.g., a tuner module, filter, register, data bus, digital circuit, and the like), under the direction of the microprocessor 20. The signal corresponds to a currently tuned frequency of radio 10 (e.g., 850 MHz). The audio synthesizer 14 produces a synthesized voice or speech announcement to indicate the currently tuned frequency, which announcement can be audibly appreciated by a pilot. The audio synthesizer 14 may include an output device (e.g., a speaker). Alternatively, audio synthesizer 14 may output a signal to an external output device (e.g., a headset or other speaker). In this manner, the pilot benefits from a feedback mechanism (e.g., the audible announcement) to determine the currently tuned frequency, even in the absence of a visual display.

In the preferred embodiment, radio 10 is reset to a predetermined frequency upon entering the emergency mode. For example, the predetermined frequency is stored in non-volatile memory, and is used to reset the radio 10 upon entering the emergency mode. A signal is provided to the audio synthesizer 14, which produces a synthesized voice or speech pattern to indicate (e.g., announce) the predetermined frequency. The pilot may adjust the frequency from this predetermined frequency, and such adjustments are preferably announced to the pilot via the audio synthesizer 14.

Figure 5:
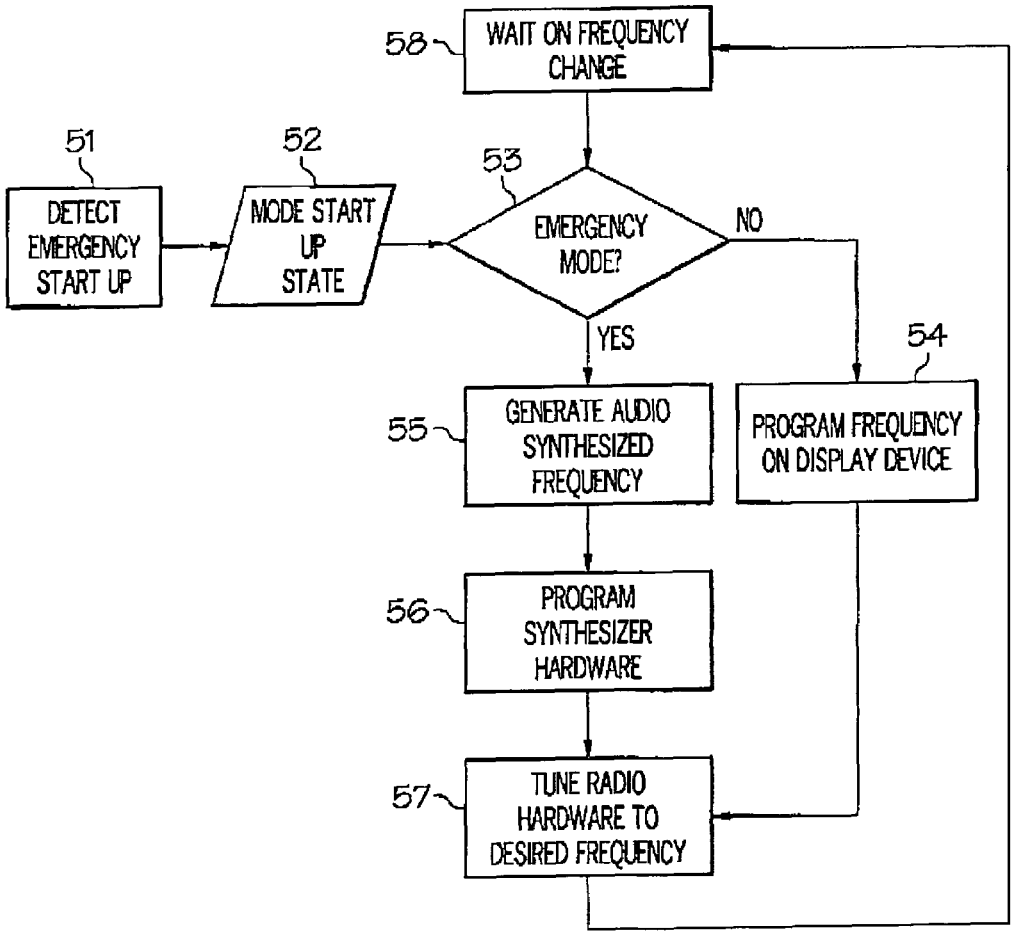
FIG. 5 is a flow diagram illustrating a method for controlling feedback mechanisms according to one aspect of the present invention.

A method of providing feedback to an operator will now be described with respect to the flow chart illustrated in FIG. 5. The process illustrated in FIG. 5 is preferably carried out by software, stored in memory, and executed by a controller or any convenient microprocessor, such as microprocessor 20. As will be appreciated by those skilled in the art, the software can be developed using known programming techniques and languages in view of the present disclosure. Such software can be stored on a computer readable medium, for example, on a floppy disk, RAM, ROM, a hard disk, removable media, other magnetic memory, flash memory, data caches, memory sticks, optical mediums, magneto-optical mediums, CD-ROMs, and so forth. Alternatively, the control shown in FIG. 5 may be carried out with a state machine or other hardware-based system.

Returning to FIG. 5, an emergency start-up (or other display device 15 failure) is detected in step S1. For example, software monitors the radio 10 to detect an emergency start-up. A start-up state mode is entered in step S2. The operating state of radio 10 is determined in the S2 step. For example, a memory location can be accessed, which stores the state of the radio 10 at start-up. In step S3, it is determined whether the radio 10 is operating in an emergency mode, due for example, to a display device 15 failure and/or radio 10 restart. A flag or other indicator can be set to indicate operation within the emergency mode. If the radio 10 is operating in the emergency mode, flow continues to step S5. On an initial pass, in step S5, the radio 10 is reset to the predetermined frequency, as discussed above. On subsequent loops, in step S5, information corresponding to the currently tuned frequency of radio 10 is determined. In either step S5 event, a desired frequency is calculated and the information for programming the audio synthesizer 14 is determined, which can be used to configure audio synthesizer 14.

The synthesizer hardware is programmed in step S6, according to the information determined in step S5, to produce an audible announcement (e.g., synthesized speech or voice). The audio synthesizer 14 may also access or update memory in step S6. Thus, an audio synthesized frequency is generated for the pilot.

The radio 10 hardware is tuned to a desired frequency in step S7. For example, the input from the pilot's frequency adjustment (e.g., input via a dial, knob, keypad, and so forth) tunes the radio 10 hardware to a desired frequency. The control waits for the frequency to change (e.g., settle in on a particular frequency) in step S8. Operation in the emergency mode is verified in step S3, and the audio synthesized frequency is generated in subsequent steps, as discussed above.

If the system is not operating in the emergency mode (as determined in step S3), the currently tuned frequency is programmed and displayed on the display device 15 in step S4. Flow continues to step S7 to tune the radio 10 hardware to a desired frequency, as discussed above.

Thus, what has been described are methods and apparatus to provide feedback of a selected frequency to a system operator. In particular, presenting a frequency with an audible announcement (e.g., a synthesized voice), in the event of a visual display failure, has been described. Procedures for controlling feedback have also been described.

The individual components shown in outline or designated by blocks in the attached drawings are all well-known in the arts, and their specific construction and operation are not critical to the operation or best mode for carrying out the invention.

While the present invention has been described with respect to what is presently considered to be the preferred embodiments, it will be understood that the invention is not limited to the disclosed embodiments. To the contrary, the invention covers various modifications and equivalent arrangements included within the spirit and scope of the appended claims. The scope of the following claims is to be accorded the broadest interpretation so as to encompass all such modifications and equivalent structures and functions.

For example, while the radio 10 has been described as including the microprocessor 20, the microprocessor 20 may be external with respect to the radio 10. Such a modification is within the scope of the present invention.

Also, as an alternative embodiment, the microprocessor 20 concurrently supplies a signal corresponding to a currently tuned frequency to both the display device 15 and the audio synthesizer 14. In a normal operating mode, the audio announcement is a redundant feedback mechanism. The dashed line between the microprocessor 20 and the audio synthesizer 14 in FIG. 3*a* illustrates this additional feedback mechanism. Similarly, in the emergency mode, the frequency signal from the microprocessor 20 may also be provided to the display device 15, in the event that the display device 15 resumes normal operation, or in the event of a false failure indication. This signal route is identified by the dashed line in FIG. 3*b*. Such modifications are within the scope of the present invention.

Furthermore, instead of (or in addition to) an audio feedback mechanism, the present invention could employ a text-based feedback, touch feedback, or even color-based feedback. Such modifications are within the scope of the present invention.

What is claimed is:

1. A system receptive to selective tuning to particular frequencies, said system comprising:

a display device;

an audio synthesizer; and a controller in communication with said display device and said audio synthesizer, wherein said controller communicates with said audio synthesizer when a malfunction is detected with respect to said display device.

2. A system according to claim 1, wherein said controller comprises an electronic processor circuit.

3. A system according to claim 1, wherein said audio synthesizer audibly synthesizes a frequency at which said system is currently tuned.

4. A system according to claim 1, wherein said system comprises a navigation system.

5. A system according to claim 1, wherein said system comprises a communications system.

6. A system according to claim 1, wherein said system comprises a navigation and communications system.

7. An apparatus adapted to be selectively tuned to individual frequencies, said apparatus communicating with an audio synthesizer and a display device, said apparatus comprising:

a processor which: i) detects a first operating mode; ii) tunes the apparatus to a predetermined frequency, if the first operating mode is detected, iii) controls the audio synthesizer to generate an audio announcement of a frequency at which the apparatus is currently tuned, if the first operating mode is detected; and iv) controls the display device to display a frequency at which the apparatus is currently tuned, if the first operating mode is not detected.

8. The apparatus according to claim 7, wherein said processor programs the audio synthesizer, if the first operating mode is detected.

9. The apparatus according to claim 8, wherein said processor tunes the radio to a selected frequency.

10. The apparatus according to claim 9, wherein after tuning the radio, said processor waits for the frequency to change.

11. The apparatus according to claim 7, wherein the first operating mode corresponds to a failure of the display device.

12. A method of providing feedback of a first selected setting in a system including a signal receiving device, said method comprising the steps of:

visually presenting the first selected setting during a first mode; and audibly presenting a second selected setting during a second mode, the second selected setting a default setting that is selected upon failure of a visual display.

13. A method according to claim 12, further comprising the step of determining the termination of the first mode.

14. A method according to claim 12, wherein the first selected setting comprises a frequency.

15. A method of providing information regarding a system, the system adapted to receive signals over a range of frequencies and adapted to tune to individual frequencies within the range, said method comprising the steps of:

tuning the system to a first frequency;

visually displaying the first frequency during a first mode of operation;

audibly announcing the first frequency during a second mode of operation; and the second mode of operation entered upon the inability to visually display the first frequency.

16. A method according to claim 15, wherein upon entering the second mode of operation, said method further comprises the steps of resetting the system to a predetermined frequency, and audibly announcing the predetermined frequency.

17. A method according to claim 15, further comprising the step of audibly announcing the first frequency during the first mode of operation.

18. A method according to claim 15, wherein said system comprises any one of a navigation system, a communications system and a navigation/communications system.

19. A method according to claim 18, wherein said system is for use in an aircraft.

20. Computer executable code stored on a computer readable medium, the code to provide information regarding a system, the system adapted to receive signals over a range of frequencies and adapted to tune to individual frequencies within the range, said code comprising code to:

tune the system to a first frequency;

visually display the first frequency during a first mode of operation;

audibly announce the first frequency during a second mode of operation; and the second mode of operation entered upon failure to visually display the first frequency.

21. A system receptive to selective tuning at particular frequencies, said system comprising:

means for displaying;

means for audio synthesizing a frequency signal; and means for controlling communication with said displaying means and said audio synthesizing means, wherein said control means communicates with said audio synthesizing means when a malfunction is detected with respect to said displaying means.

22. Computer executable software code stored on a computer readable medium, the code for use with an apparatus adapted to be selectively tuned to individual frequencies, the apparatus communicating with an audio synthesizer and a display device, said code comprising code to:

detect a first operating mode;

tune the apparatus to a predetermined frequency, if the first operating mode is detected;

control the audio synthesizer to generate an audio announcement of a frequency at which the apparatus is currently tuned, if the first operating mode is detected; and control the display device to display a frequency at which the apparatus is currently tuned, if the first operating mode is not detected.

* * * * *